US005597264A

United States Patent [19]

Laak

[11] Patent Number: 5,597,264

[45] Date of Patent: Jan. 28, 1997

[54] LEACHING FIELD AND METHOD OF MAKING

[76] Inventor: Rein Laak, 149 Browns Rd., Storrs Mansfield, Conn. 06268-2808

[21] Appl. No.: 497,220

[22] Filed: Jun. 30, 1995

[51] Int. Cl.[6] ..... E02B 13/00; B01D 43/00

[52] U.S. Cl. ..... 405/36; 405/43; 405/45; 33/562; 33/613; 210/170; 210/532.2

[58] Field of Search ..... 405/43, 45, 36, 405/52; 210/747, 170, 532.2; 33/529, 562, 613, 645

[56] References Cited

U.S. PATENT DOCUMENTS 2,536,196 1/1951 MacLeod ..... 405/43

4,917,536 4/1990 Glasser ..... 405/36 X

*Primary Examiner*—Tamara L. Graysay
*Assistant Examiner*—Tara L. Mayo
*Attorney, Agent, or Firm*— McCormick, Paulding & Huber

[57] ABSTRACT

A leaching field is prepared by fitting together segments of PVC pipe in the manifold configuration that defines a plurality of outlets, each outlet having a unique in-drain configuration with an internal core and external non-woven geotextile fabric envelope. The method calls for supporting these relatively flexible in-drains with a template while space between the in-drains is filled with sand or the like. In a further embodiment each of the in-drains is fitted with a stand pipe that is useful to backflush the in-drains periodically.

5 Claims, 3 Drawing Sheets

LEACHING FIELD AND METHOD OF MAKING

BACKGROUND OF THE INVENTION

This invention relates generally to leaching fields associated with septic systems that require draining of the effluent from the septic tank into the soil. Prior art leaching fields generally take the form of trenches filled with an aggregate such as stone, and perforated distribution pipes provided above the stone filled trenches to convey the effluent from the septic tank on top of the trenches.

Such conventional leaching fields suffer from the disadvantage of requiring rather extensive excavation of the surrounding soil, and from plugging of the holes generally provided in the perforated distribution pipes, leading to uneven distribution of the effluent.

The present invention has the advantage of not requiring stones, nor requiring any distribution pipes with such holes. The invention provides the further advantage of relatively quick installation, particularly when a template is utilized in accordance with the present invention to position the "in-drains" which replace the perforated distribution pipes and the stone filled trenches required in such prior art leaching fields.

SUMMARY OF THE INVENTION

In accordance with the present invention a leaching field is fabricated by providing a distribution manifold downstream of the conventional septic tank for receiving the effluent from the tank, and directing this effluent through parallel outlets provided in the manifold. In-drains are provided in the form of geotextile fabric-wrapped plastic cores or fins. These wrapped geotextile fabric envelopes are preferably in the shape of rectangularly elongated elements with one end coupled to an outlet of the distribution manifold. These in-drain elements are held in upright position generally parallel one another by a template used to so support the elements while sand is provided therebetween. This configuration requires only a very shallow trench or excavation, the depth of which is on the same order of magnitude as the spacing between the generally rectangular envelopes containing the fins. Each of these in-drain elements is approximately seven inches in height dictating need for a relatively shallow excavation to receive a plurality of these elements in side by side relationship. These elements are flexible since they are many feet in length, and in accordance with the present invention a template is provided to support these elements in position while sand is filled in around them in the vicinity of this template. The template can be moved downstream from an initial position adjacent the manifold to which the upstream ends of the in-drain elements are coupled.

Another feature of the present invention is to provide standpipes at the downstream ends of these elements, which standpipes are capped. These standpipes can be periodically uncapped to permit backflushing of the envelopes, a feature which considerably lengthens the life of the leaching field itself.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DETAILED DESCRIPTION

Turning now to the drawings in greater detail, the present invention relates to an improved leaching field for a conventional septic system of the type where domestic wash water (gray water) is combined with domestic waste material (black water) for disposal and dispersal in the soil from a conventional septic system holding tank or the like.

Figure 1:
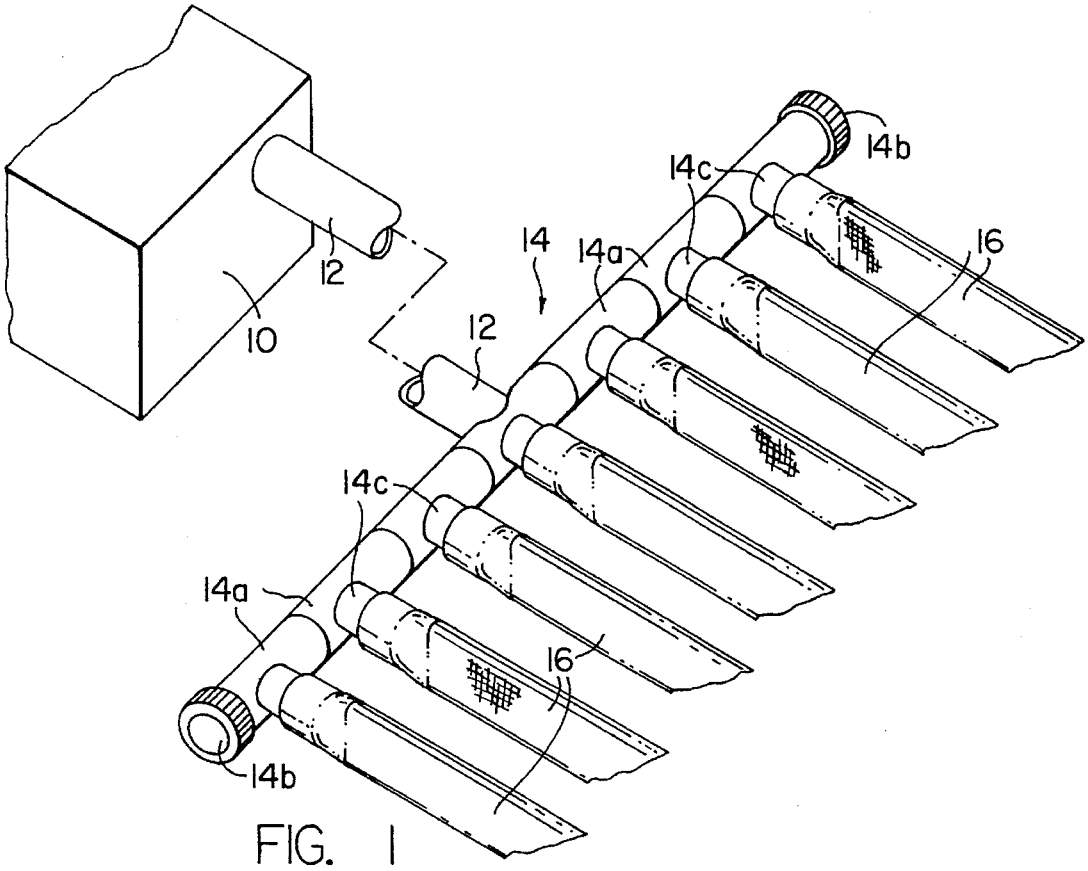
FIG. 1 shows in a schematic fashion the overall relationship between a conventional septic tank and a manifold pipe fitted with in-drain elements in accordance with the present invention.
Figure 2:
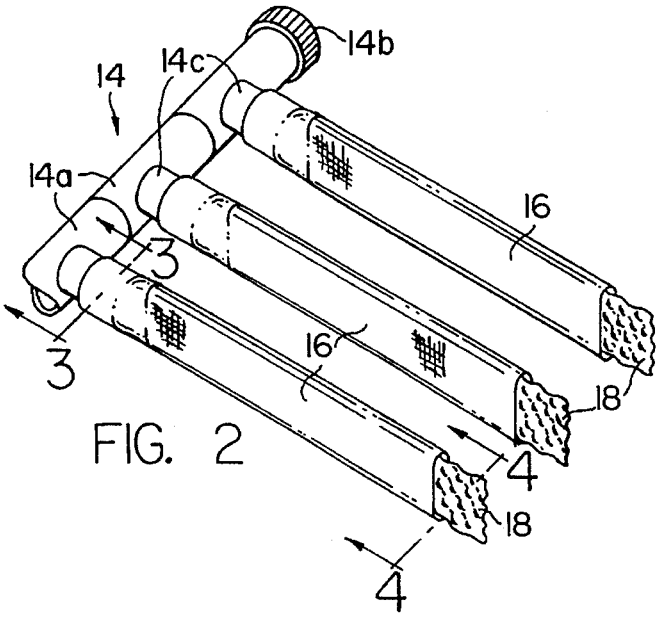
FIG. 2 is a more detailed view of a portion of the manifold and associated in-drains elements.

Considering first FIG. 1, a conventional holding tank is indicated generally at 10, such a holding tank being used to separate, by gravity, solid materials from the waste water itself. The waste water is drawn off the holding tank 10 through a distribution pipe 12, and instead of being fed to a distribution box or conventional leaching field the present invention calls for the pipe 12 to feed such waste water into a manifold 14. The manifold is horizontally oriented so as to be fed waste water from the distribution pipe 12 as required to dispose of the excess water in the holding tank 10. As used in a household septic system the manifold 14 preferably comprises a plurality of T-sections 14*a* that are connected to one another by a short nipple or the like so as form a linear pipe with end caps 14*b* as shown.

Figure 3:
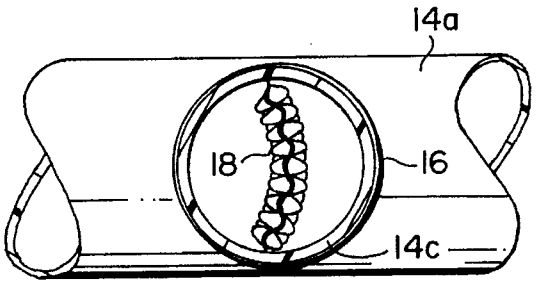
FIG. 3 is a sectional view taken on the line 3—3 of FIG. 2.
Figure 4:
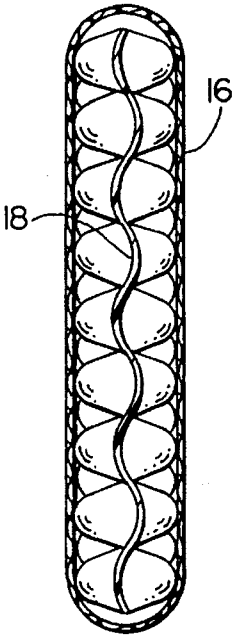
FIG. 4 is a sectional view taken on the line 4—4 of FIG. 2.

The stem of each T-section 14*a* is fitted to an envelope 16 that comprises a nonwoven geotextile fabric material which is pervious to water but relatively impervious to sand and soil. This envelope 16 is provided with an elongated internal plastic core 18, and it is an important feature of the present invention that the core 18 comprises an expanded sheet material designed to maintain a predetermined width between the sides of the envelope 16 as best shown in FIG. 4. This core sheet 18 may comprise a plastic styrene material that is heated and dimpled to provide opposing hills and valleys on opposite sides of the sheet 18 in accordance with conventional practice. Each core 18 in each envelope 16 gives each in-drain a generally elongated rectangular configuration. However, the core sheet 18 is flexible enough to permit the sheet to be bent in an arcuate shape as suggested at 18 in FIG. 3 so as to be insertable into the open end of the projecting stem portion 14*c* of each T-section 14*a*. If necessary the nonwoven geotextile fabric envelope 16 can be secured around the stem 14*c* of the T-section by suitable fastener devices (not shown) such as string and/or plastic ties.

Figure 5:
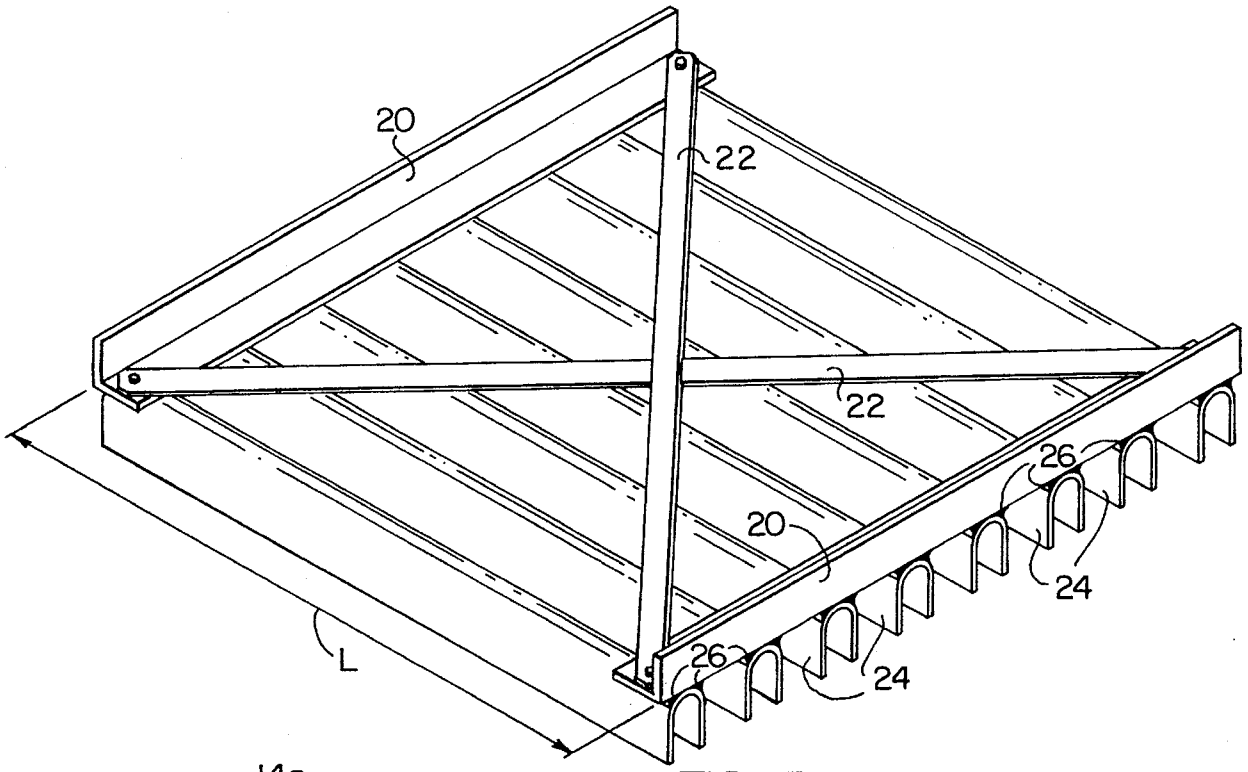
FIG. 5 is a perspective view of a template which is useful in practicing the method of the present invention.
Figure 6:
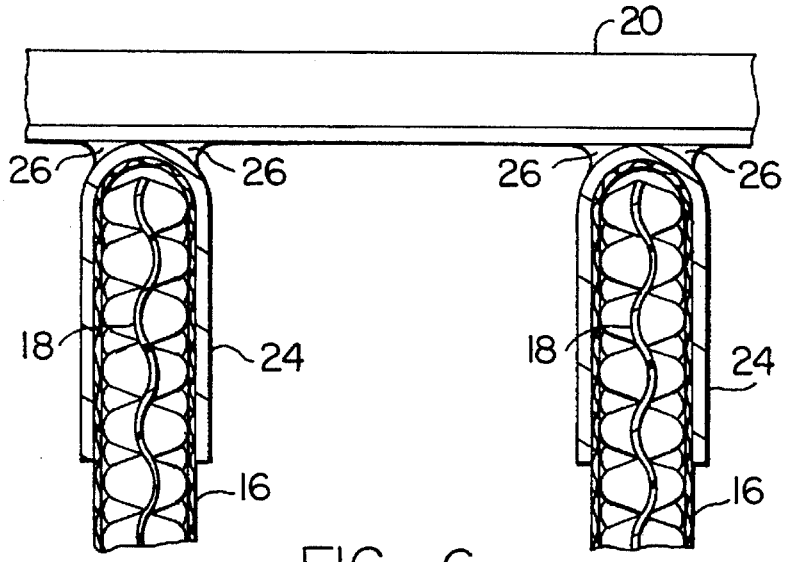
FIG. 6 is a detailed view of a portion of a template of FIG. 5 in association with two of the in-drains among the plurality of parallel in-drains as assembled in the system of FIG. 1.

In accordance with the method of the present invention the in-drain, including each envelope 16 and associated core 18, is held in a vertical orientation and they are preferably held parallel to one another and in spaced relationship relative to one another by a template such as that shown in FIG. 5. FIG. 6 shows the template as including downwardly open U-shaped portions for supporting each envelope 16 and core 18 in a generally vertical orientation so as to permit filling the spaces between these in-drains during installation of a leaching field in accordance with the method of the invention. The method may further include the step of providing a preliminary sand layer prior to the coupling of the envelopes to the outlets of the distribution manifold.

The template of FIG. 5 is made up of end braces 20,20 which are in the form of angle irons, and supported in spaced relationship to one another by cross braces indicated generally at 22. The overall length "L" of the template of FIG. 5 will be considerably less than the overall length of the individual elongated in-drains or envelope 16. Therefore, the template must be moved from and to successive positions during the process of filling the spaces between these in-drains. Downwardly open U-shaped in-drain support members 24 are supported at their ends by the end braces 20,20. As suggested in FIG. 6 these U-shaped supports 24,24 may be welded to the end braces 20 as indicated generally at 26.

Figure 7:
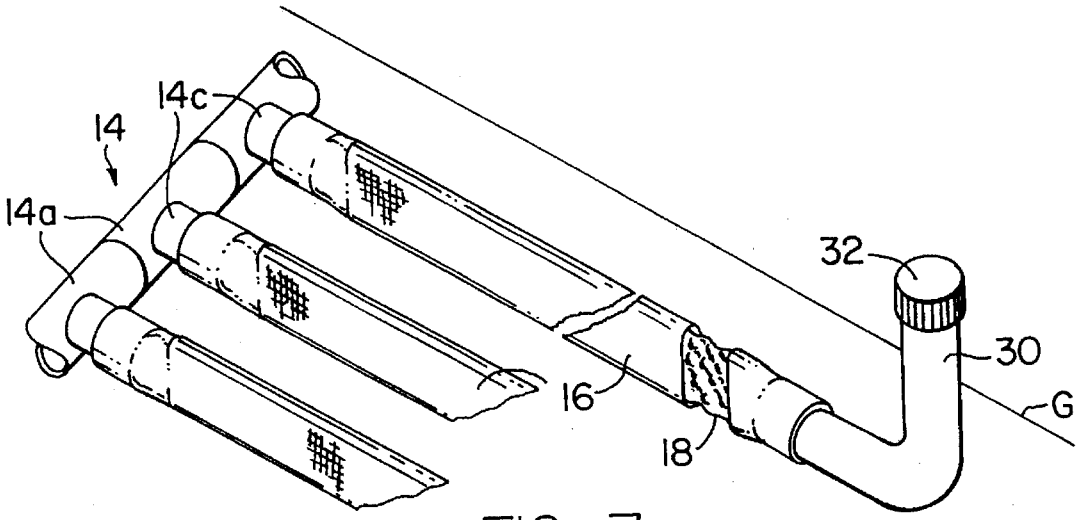
FIG. 7 is a view similar to FIG. 2 but showing an alternative embodiment of the present invention wherein each of the in-drains is equipped with a backwash standpipe to allow flushing of the leaching field of the present invention.

Turning now to a detailed description of FIG. 7, a leaching field constructed in accordance with the present invention and installed in accordance with the present method includes the components described previously, and in addition standpipes 30 are provided at the ends of the in-drain elements opposite the ends coupled to the outlet openings of the manifold. The ground level is illustrated generally at "G" but may be slightly below the upper capped end of the standpipe illustrated generally at 32. The standpipes associated with the various in-drain elements may be periodically flushed with a clear liquid or water to increase the effective life of a leaching field of the present invention. Normally, leaching fields can be expected to function, even with periodic maintenance, only approximately 15–25 years. In a leaching field in accordance with the present invention this 25 year life can be further increased by providing standpipes in accordance with the present invention so as to permit backflushing of the in-drain elements to remove solids or at least return these solids to the holding tank. Because most of the clogging will necessarily occur on the inside of the fabric the standpipes afford opportunity to rinse the fabric from the inside. The ability of the in-drains to achieve proper infiltration of the waste water into the surrounding soil can be increased significantly over that possible with a conventional leaching field if backwashing is accomplished to extend the life of the system. It is recommended that backwashing be accomplished by providing a minimum pressure of two feet of water through the in-drain. Again, the rinsing cycle is carried out until no bulk solids appear in the rinse water at the holding tank or at some other outlet provided between the holding tank and the leaching field for this purpose. Pumping of the holding tank might be required in the event that the backwash water is returned to the septic tank itself.

Obviously many modifications and variations of the present invention will become apparent in light of the above teachings. For example: in-drain structures of different geometry could be adapted for use in accordance with the method of the present invention. While the recommended spacing and depth of the in-drains is on the same order of magnitude it will be apparent that relatively deeper or vertically extended in-drains might be required in certain situations where the area devoted to installation of the leaching field is limited for example. Although four inch polyvinyl chloride (PVC) pipe is recommended for use in domestic leaching fields constructed in accordance with the present invention other sizes might be adapted as well as other materials for use in connection with in-drains similar to those described above. A variety of such in-drain configurations have been described in the prior art and will not be repeated here. For present purposes it is sufficient to note that the preferred form of in-drain comprises a nonwoven geotextile fabric wrapped around a plastic dimpled core sheet, and that such an in-drain requires no holes in the envelope thereby avoiding the necessity for extensive labor otherwise required during installation. The use of the template of the present invention greatly facilitates positioning of the in-drains during the process of filling the spaces between them. Once the in-drains have been installed a layer of sand is provided on top of the manifold 14, and the associated in-drain structure, and it is a feature of the present invention that the leaching field of the present invention when so covered will support even heavy equipment passing immediately thereabove.

In light of the above, it is therefore understood that within the scope of the appended claims, the invention may be practiced otherwise than as specifically described.

We claim:

1. The method for fabricating a leaching field associated with a septic system comprising the following steps:

providing a distribution manifold in a horizontal orientation downstream of the septic tank for receiving the effluent from that tank, and directing the effluent through parallel outlets provided in the manifold in a direction generally perpendicular to the manifold, coupling in-drains of geotextile fabric envelopes surrounding an elongated rectangular fin to each of these outlets of the distribution manifold, placing a template on top of a plurality of such in-drain envelopes to support them in upright parallel spaced relationship to one another, and filling the spaces between the in-drain envelopes with a sandy soil to provide an improved leaching field for the septic system.

2. The method of claim 1 further including the additional step of backwashing these in-drain envelopes by periodically introducing water under pressure to standpipes located at the other ends of the in-drain envelopes.

3. The method of claim 1 further including the intermediate steps of moving the template from and to successive locations spaced along the elongated in-drain envelopes, and said filling step being accomplished in successive stages to fill only those spaces that are defined by envelopes held upright by the template.

4. The method of claim 1 including the additional step of providing a preliminary sand layer prior to the coupling of the envelopes to the outlets of the distribution manifold.

5. In a septic system wherein effluent from a septic tank or distribution box must be drained into the surrounding soil by a leaching field or its equivalent, the improvement comprising:

a horizontally oriented manifold pipe for receiving the effluent from the septic tank or distribution box, said manifold pipe having outlets spaced along its length, a plurality of in-drain devices coupled to said manifold pipe outlets, each in-drain device including a geotextile fabric envelope in a plastic core contained inside the envelope to define passageways on both sides of said core that are covered by said geotextile fabric envelope, one end of each envelope being in communication with one of said manifold outlets and said in-drain devices being otherwise unsupported except by the surrounding soil or sandfill that is provided in the spaces between said in-drain devices, and template means supporting said in-drain devices during the process of providing the spaces between the in-drains with sand.

* * * * *